United States Patent [19]

Crowe

[11] 4,084,291

[45] Apr. 18, 1978

[54] CENTER HINGE FOR TOP-MOUNT, TWO-DOOR REFRIGERATOR

[75] Inventor: William P. Crowe, Louisville, Ky.

[73] Assignee: General Electric Company, Louisville, Ky.

[21] Appl. No.: 747,047

[22] Filed: Dec. 2, 1976

[51] Int. Cl.[2] ..... E05D 7/02; E05D 15/50

[52] U.S. Cl. ..... 16/170; 49/193; 49/382; 312/329

[58] Field of Search ..... 16/170, 168, 128 R, 16/176, DIG. 23; 49/382, 193, 402; 312/109, 329

[56] References Cited

U.S. PATENT DOCUMENTS

| | | | |
|---|---|---|---|
| 2,701,384 | 2/1955 | Barroero | 16/168 X |
| 3,125,390 | 3/1964 | Woolley | 312/329 |
| 3,389,424 | 6/1968 | Fellwock | 16/170 |
| 3,430,386 | 3/1969 | Sandin et al. | 49/382 |
| 3,455,061 | 7/1969 | Kesling et al. | 49/382 |
| 3,863,391 | 2/1975 | Horvay et al. | 49/382 |

FOREIGN PATENT DOCUMENTS

| | | | |
|---|---|---|---|
| 1,559,823 | 9/1970 | Germany | 16/168 |

*Primary Examiner*—James Kee Chi
*Attorney, Agent, or Firm*—Francis H. Boos

[57] ABSTRACT

Door mounting structure for reversibly mounting two vertically aligned doors on a cabinet such as a combined refrigerator/freezer. Upper and lower removably mounted hinge pins are disposed at the top and bottom of the cabinet adjacent a first side thereof. An intermediate hinge bracket is located adjacent the bottom edge of the upper door and the top edge of the lower door. This hinge bracket has a mounting portion and a support portion. The support portion is adapted to extend between the two doors and it includes a pivot hole for a slip fit with a double hinge pin. This intermediate hinge bracket is inverted in one side hinge position as compared with the opposite side hinge position. This hinge bracket also includes a side arm that has a lost-motion connection to a front frame of the cabinet to stabilize the mounting portion of the bracket.

2 Claims, 4 Drawing Figures

CENTER HINGE FOR TOP-MOUNT, TWO-DOOR REFRIGERATOR

BACKGROUND OF THE INVENTION (1) Field of the Invention

This invention relates to reversible hinging means for a side-swinging door, and particularly to a reversible center hinge means between two doors which are vertically aligned.

(2) Description Of the Prior Art

Patents are available showing two-door refrigerators with reversible hinges, such as the Fellwock U.S. Pat. No. 3,389,424, which issued June 25, 1968. FIG. 2 of this patent is a schematic front elevational view of a three-door refrigerator illustrating the selective disposition of the hinge system elements for alternate left and right-hand door-swinging arrangements. FIGS. 8 and 9 of this Fellwock patent show the details of the center or intermediate hinge, but in all cases this center hinger is located above the top edge of the lower door. The double hinge pin is a fixed pin, and this center hinge must be inverted as it is exchanged from one side of the cabinet to the other, but in both positions the mounting screws for the center hinge are apparently accessible despite the presence of the lower door.

Another patent showing a two-door refrigerator with reversibly mounted doors is the Sandin/Schmitt U.S. Pat. No. 3,430,386, which issued Mar. 4, 1969, and is assigned to the same assignee as is the present invention. In this patent, there is an elongated L-shaped bracket which extends the entire width of the cabinet in the area between the two vertically aligned doors. The double hinge pin used in this patent is a threaded member that is threaded into threaded openings in the L-shaped bracket, either at the right end or the left end of the bracket.

A third patent showing a two-door refrigerator with reversible hinge means is that of Kesling/Watt, U.S. Pat. No. 3,455,061, which issued July 15, 1969. The top door has a hinge means in each one of the four corners of the door, and two of these hinge means on the same side of the door are inactivated for swinging the door in one direction about the two remaining hinge means. If a reverse swinging action is desired, then the two active hinges are inactivated and the two inactive hinges are activated. The lower door of this patent has a hinge means in each of its two lower corners, and they cooperate with the hinges in the two lower corners of the upper door. The patent does not have a reversible center hinge as in the present invention. This design is apparently an expensive design that requires a surplus of hinge means.

SUMMARY OF THE INVENTION

The present invention, in accordance with one form thereof, relates to a cabinet having upper and lower vertically aligned doors. An upper pivot means is removably mounted on the cabinet adjacent either a right or a left-hand side thereof, and it is adapted to engage the top edge of the upper door adjacent either side thereof so as to provide an upper pivot axis for the upper door. There is also a lower pivot means removably mounted on the cabinet adjacent either a right or a left-hand side thereof in vertical alignment with the upper pivot means. This lower pivot means is adapted to engage the bottom edge of the lower door adjacent either side thereof to provide a lower pivot axis for said lower door. The invention comprises an intermediate pivot means removably carried by the cabinet between the upper and lower doors. This intermediate pivot means comprises an angular hinge bracket having a mounting portion and a support portion that is adapted to extend between the two doors. The support portion includes a pivot hole for receiving a double hinge pin. The lower portion of the hinge pin is telescoped into the bottom edge of the upper door. The center hinge bracket is inverted in one side hinge position as compared with the opposite side hinge position.

BRIEF DESCRIPTION OF THE DRAWINGS

This invention will be better understood from the following description taken in conjunction with the accompanying drawings and its scope will be pointed out in the appended claims:

DESCRIPTION OF THE PREFERRED EMBODIMENT

Figure 1:
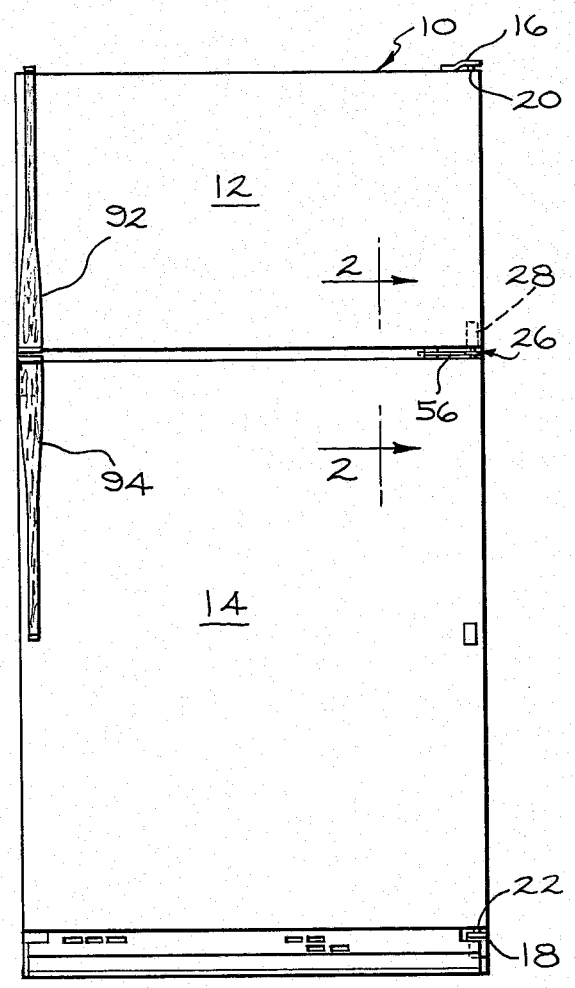
FIG. 1 is a front view of a top-mount, two-door refrigerator/freezer cabinet furnished with reversible hinge means for the doors so that the doors may swing either about a right-hand pivotal axis as shown in this FIG., or they may be made to swing about a left-hand pivotal axis.

Turning now to a consideration of the drawings, and in particular to FIG. 1, there is shown a household two-door refrigerator/freezer cabinet 10 having two vertically aligned doors 12 and 14, where the smaller upper door 12 is for gaining access to a top-mount freezer compartment, while the larger lower door 14 is for gaining access to the lower fresh food compartment, as is well known in this art.

As is conventional in the refrigerator art, double refrigerator doors are supported for side-swinging action by a first pair of upper and lower hinge brackets 16 and 18 that are fastened adjacent the front of the refrigerator cabinet near the corner of the top edge of the upper door and the corner of the bottom edge of the lower door. The top hinge bracket 16 is provided with a downwardly facing hinge pin 20 that is received within a thimble (not shown) that is built into the top edge of the door 12. The lower hinge bracket 18 has an upwardly projecting hinge pin 22 that is received within a thimble (not shown) that is built into the lower edge of the lower door 14, as is conventional in this art.

The present invention is primarily concerned with the design of an intermediate or center hinge bracket 26 that is adapted to support the lower edge of the upper door 12 and the upper edge of the lower door 14, as well as to be reversible so that it may be mounted at either the left-hand side or the right-hand side of the cabinet. The center hinge bracket 26 is an angular member having a vertical mounting strap 28 and a horizontal support strap 30 that is adapted to be located between the lower edge 32 of the upper door 12 and the upper edge 34 of the lower door 14. The vertical mounting strap 28 is an elongated member that is furnished with a pair of vertically spaced screw openings for receiving the mounting screws 36 and 38 that are threaded into the front face of the refrigerator cabinet 10.

Figure 2:
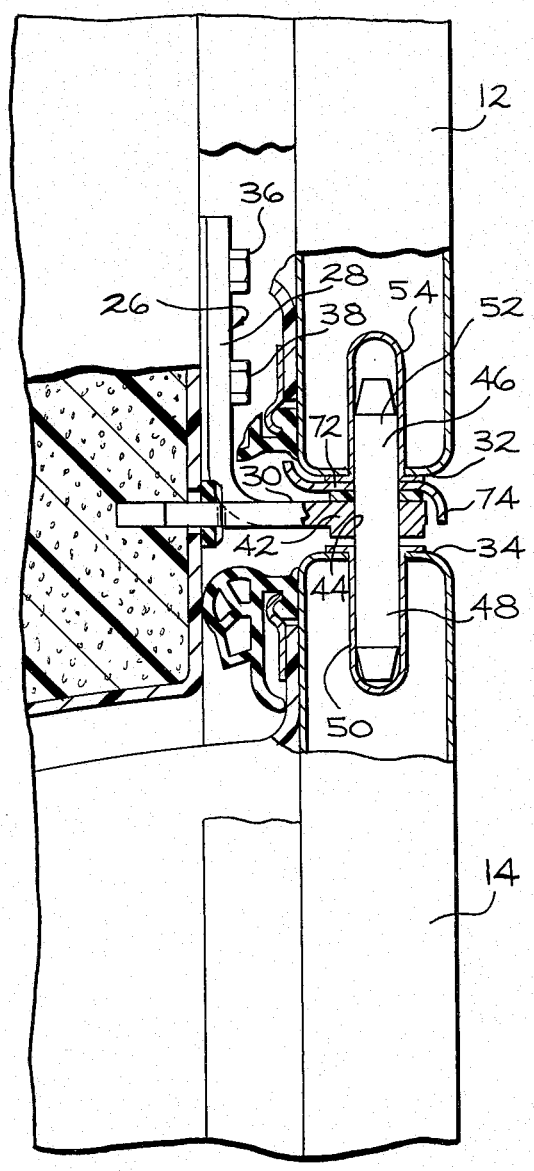
FIG. 2 is a fragmentary side elevational view on an enlarged scale taken on the line 2—2 of FIG. 1 to show the nature of the center hinge bracket for supporting the lower edge of the upper door and the upper edge of the lower door.

The horizontal support strap 30 is a cantilever that is provided with an enlarged or thickened end 42 which has a vertical pivot hole 44 therein for receiving a double hinge pin 46 therein with a slip fit. The lower half 48 of the double hinge pin 46 is received into a close-fitting thimble 50 that is built into the top edge 34 of the lower door 14, as is best seen in FIG. 2. The upper half 52 of the double hinge pin 46 extends into an inverted thimble 54 that is built into the lower edge 32 of the upper door 12.

It will be understood by those skilled in this art that to assemble the two doors 12 and 14 the lower hinge bracket 18 and the center hinge bracket 26 are assembled first to the front frame of the cabinet. The double hinge pin 46 is removed from the center hinge bracket 26. Then the door 14 is lifted into place so that the lower hinge pin 22 of the lower hinge bracket 18 will slip into the thimble in the lower edge of the door 14. Then the double hinge pin 46 is inserted down into the pivot hole 44 of the center hinge bracket 26 to fit into the thimble 50 in the top edge of the lower door 14. Next, the upper door 12 would be positioned so that it would lower over the top half 52 of the double hinge pin 46. Lastly, the top hinge bracket 16 would be fastened in place with its pivot pin 20 inserted down into the thimble (not shown) in the top edge of the upper door 12.

Figure 3:
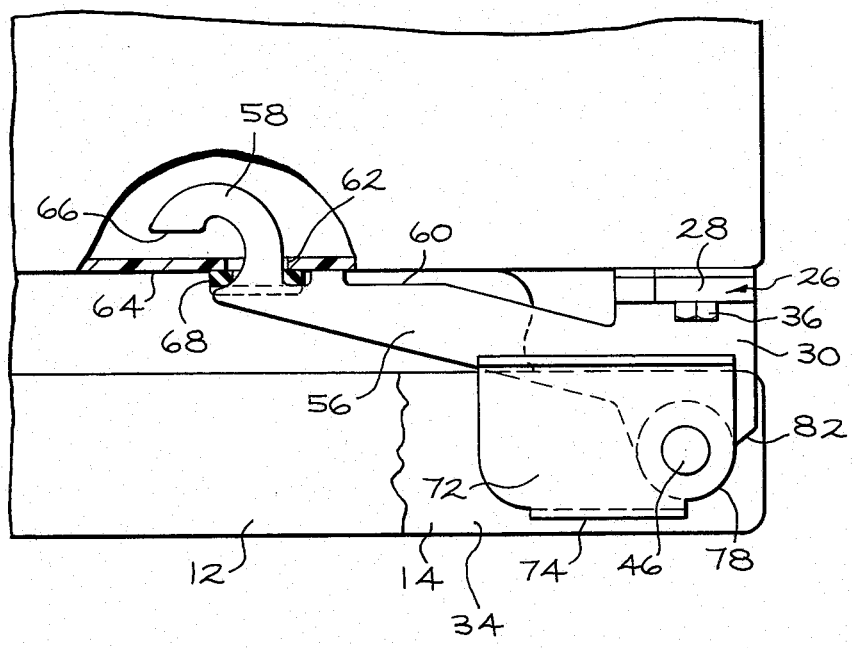
FIG. 3 is a top plan view of the center hinge bracket of FIG. 2 with parts of the top door and the front frame of the cabinet broken away to show the nature of the elongated side arm that extends from the support portion of the center hinge bracket to stabilize the mounting portion of the bracket, as well as serving as a swing limiting means. The door gaskets have been left out to gain a better view of the center hinge bracket.

Because the mounting strap 28 of the center hinge bracket 26 is a narrow vertical member, it is well to provide a horizontal stablizing arm 56, as is best seen in the plan view of FIG. 3, to reinforce the holding action of the mounting strap 28. This stabilizing arm 56 is an elongated extension from the inner side of the support strap 30, and it has at its distal end a rear hook portion 58 on its back side 60. A small opening 62 is formed in the front frame or mullion 64 that extends from one side to the other of the cabinet and the lower fresh food compartment. This rear hook portion 58 is a semi-circular formation having a flat face 66 that lies generally parallel to the inner side of the front face or mullion 64 but is normally spaced from the surface by about $\frac{1}{8}$ to $\frac{1}{4}$ inch. Notice there is a resilient pad 68 that is fastened on the base of the hook member 58 just outside the opening 62 to prevent metal-to-metal contact, as well as to seal the opening.

A strong metal base plate 72 is fitted to the underside of the top door 12 in the vicinity of the thimble 54. The front edge of this base plate 72 is folded down as at 74 to be in the same plane as the support strap 30, as is clear from FIG. 2. Now looking at FIG. 3, the area of the support strap 30 in the vicinity of the double hinge pin 46 is rounded as at 78 so as not to interfere with the base plate flange 74 as the door is moved from its closed position to an open position. The support strap 30 is however provided with a stop, as at 82, so that after the door has moved through an angle of about 105° the flange 74 will strike the stop 82 and any further opening movement of the door will cause the center hinge bracket 26 to twist slightly with the front frame of the cabinet. This twisting motion is limited by the stabilizing arm 56 and especially the flat face 66 of the hook portion 58 of the arm bearing against the backside of the front frame or mullion 64.

It is desirable to be able to change the hinge means for the doors so the doors may pivot about either side of the cabinet. This may be accomplished by moving the hinges from the right-hand side to the left-hand side of the cabinet. It is a simple transposition to shift the top hinge bracket 16 and the bottom hinge bracket 18 of FIG. 1 over to the left-hand side of the cabinet. Holes for receiving the screws that mount these hinge brackets would be partially pre-punched, to facilitate the proper location of the hinge brackets.

Figure 4:
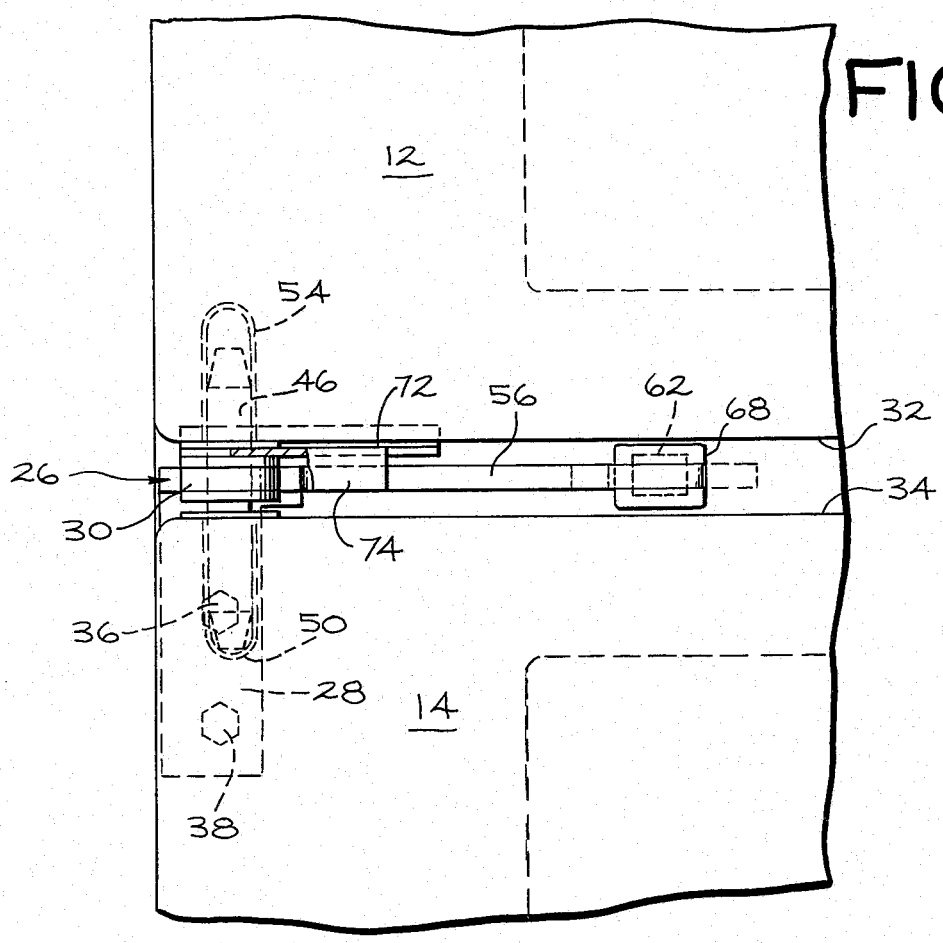
FIG. 4 is a fragmentary front elevational view of the center hinge bracket shown mounted at the left-hand side of the cabinet in its inverted position from its right-hand position of FIG. 1.

Different conditions apply to the center hinge bracket 26 than apply to the top and bottom hinge brackets, because the center hinge bracket 26 is not symmetrical as it has the elongated side arm 56, and it must always extend inwardly toward the center of the cabinet door. Thus, the center hinge bracket 26 must be inserted at the left-hand side of the cabinet from the position it has at the right-hand side of the door so the side arm 56 will be directed inwardly of the left-hand side of the cabinet, as is best seen in FIG. 4. When the center hinge bracket 26 is inverted, the vertical mounting strap 28 will be directed downwardly. Hence, the lower door 14 covers over the two mounting screws 36 and 38. Accordingly, the center mounting bracket 26 must be mounted to the front frame or mullion 64 before the lower door is mounted to the cabinet. If the double hinge pin 46 were integral with the center hinge bracket 26, then the center hinge bracket 26 could not be mounted to the cabinet before the lower door 14 was in place because the lower half 48 of the hinge pin 46 would interfere with the door and it would not be possible to fit the hinge pin into the thimble 50.

It is important in the present invention that the double hinge pin 46 is made to have a slip fit with respect to the vertical pivot hole 44 in the horizontal support strap 30 for ease of assembly, but freedom from wobbling with respect to the horizontal support strap or with respect to the thimbles of the two doors 12 and 14.

Of course, when the hinge brackets are shifted from one side of the cabinet to the other, the door handles 92 and 94 must also be shifted, so as to be located opposite the door hinges.

Modifications of this invention will occur to those skilled in this art. Therefore, it is to be understood that this invention is not limited to the particular embodiments disclosed, but that it is intended to cover all modifications which are within the true spirit and scope of this invention as claimed. What is claimed is:

1. An arrangement for reversibly mounting upper and lower vertically aligned doors on a refrigerator cabinet, comprising:

upper pivot means removably mountable on said cabinet substantially adjacent either the right- or left-hand side thereof, said upper pivot means adapted to cooperatively engage the top edge of the upper door adjacent either side thereof;

lower pivot means removably mountable on said cabinet substantially adjacent either the right- or left-hand side thereof in vertical alignment with said upper pivot means, said lower pivot means adapted to cooperatively engage the bottom edge of the lower door adjacent either side thereof;

a non-symmetrical hinge pin bracket mountable generally between the upper and lower doors adjacent either the right-or left-hand side of the cabinet, said non-symmetrical bracket having a vertical mounting strap for attachment to the front face of the cabinet by means of a mounting screw, and having a horizontal support portion joined to one end of said mounting strap, with an elongated horizontal side arm joined to the support portion, the distal end of the side arm extending inwardly and connectable to the horizontally-extending front frame of the cabinet to stabilize said bracket, whereby, when said bracket is mounted generally adjacent one side of the cabinet, the mounting strap is directed upwardly and extends above the upper edge of the lower door, and, when said bracket is mounted generally adjacent the other side of the cabinet, the mounting strap is directed downwardly and extends below the upper edge of the lower door, the lower door blocking access to the mounting screw;

said support portion including a pivot hole in vertical alignment with the corresponding upper and lower pivot means; and a double hinge pin loosely received in the pivot hole with the lower portion of the double hinge pin telescoped into a mating sleeve in the top edge of the lower door, and the upper portion of the hinge pin telescoped into a mating sleeve in the bottom edge of the upper door.

2. The arrangement of claim 1, wherein the pivot hole comprises a cylindrical bearing having a close-fitting relationship with said double hinge pin so that said hinge pin is limited to vertical movement for ease of assembly and disassembly.

* * * * *